US007337833B2

(12) United States Patent
Laveran et al.

(10) Patent No.: US 7,337,833 B2
(45) Date of Patent: Mar. 4, 2008

(54) CIRCUIT ELEMENT FOR HEAT EXCHANGER, IN PARTICULAR FOR MOTOR VEHICLE, AND RESULTING HEAT EXCHANGER

(75) Inventors: Jean-Louis Laveran, Asnieres (FR); Jacques Hoffnung, L'lle Saint Denis (FR); Jerome Genoist, Versailles (FR)

(73) Assignee: Valeo Thermique Moteur S.A.S., La Verriere (FR)

( * ) Notice: Subject to any disclaimer, the term of this patent is extended or adjusted under 35 U.S.C. 154(b) by 493 days.

(21) Appl. No.: 10/499,871

(22) PCT Filed: Dec. 23, 2002

(86) PCT No.: PCT/FR02/04540

§ 371 (c)(1),
(2), (4) Date: Jun. 23, 2004

(87) PCT Pub. No.: WO03/056268

PCT Pub. Date: Jul. 10, 2003

(65) Prior Publication Data

US 2004/0244955 A1 Dec. 9, 2004

(30) Foreign Application Priority Data

Dec. 28, 2001 (FR) ..... 01 17033

(51) Int. Cl.
*F28F 9/04* (2006.01)

(52) U.S. Cl. ..... 165/153; 165/175

(58) Field of Classification Search ..... 165/153, 165/173, 175
See application file for complete search history.

(56) References Cited

U.S. PATENT DOCUMENTS

| | | | | |
|---|---|---|---|---|
| 4,258,785 | A * | 3/1981 | Beldam | 165/175 |
| 4,969,512 | A * | 11/1990 | Hisao et al. | 165/153 |
| 6,032,728 | A * | 3/2000 | Ross et al. | 165/153 |
| 6,170,567 | B1 * | 1/2001 | Nakada et al. | 165/153 |
| 6,220,340 | B1 * | 4/2001 | Cheong et al. | 165/103 |
| 6,467,536 | B1 * | 10/2002 | Abate et al. | 165/153 |
| 6,745,826 | B2 * | 6/2004 | Lowenstein et al. | 165/115 |

* cited by examiner

*Primary Examiner*—Allen J. Flanigan
(74) *Attorney, Agent, or Firm*—Howard & Howard Attorneys, P.C.

(57) ABSTRACT

The invention relates to a hydraulic circuit element (20) for heat exchange between a first fluid and a second fluid, which defines a path for the first fluid and comprises at least one tube (22) having two ends and at least one tip (24) at one of said ends of the tube (22), said tip having at least one communicating passage (28*b*) that defines the path of the first fluid. The invention also relates to a heat exchanger obtained by stacking circuit elements (20). Such a heat exchanger can be used in particular in motor vehicles.

23 Claims, 7 Drawing Sheets

CIRCUIT ELEMENT FOR HEAT EXCHANGER, IN PARTICULAR FOR MOTOR VEHICLE, AND RESULTING HEAT EXCHANGER

The invention relates to a circuit element for a heat exchanger, especially a heat exchanger intended for equipping a motor vehicle.

More precisely, it relates to a circuit element for heat exchange between a first fluid and a second fluid, which defines a path for the first fluid.

It also relates to heat exchangers obtained from these circuit elements.

Such exchangers generally consist of a bundle of parallel tubes mounted between two header boxes, the tubes alternating with spacers, for example of the corrugated type. Also known are exchangers consisting of a single tube folded in the form of a coil. Such exchangers have many applications and may in particular be used as condensers in air-conditioning circuits on motor vehicles.

However, these known exchangers have many drawbacks. As regards the technology of exchangers with tubes and header boxes, the latter increase the size of the exchangers without increasing their performance. The header boxes do not improve the heat exchange and they waste space.

Moreover, the exchanger must necessarily be rectangular in shape owing to the presence of the header boxes. Furthermore, to create passes in the exchanger, it is necessary to add and incorporate additional pieces—partitions—in the header boxes.

Finally, the manufacture of these exchangers is difficult as it is necessary to punch and pierce the header plates. It is tricky to insert thin-walled tubes into a large header with small tolerances.

Coil exchangers do not allow passes to be made. Their manufacture is lengthy because it is difficult to industrialize. A great deal of time is needed to manufacture a coil with a machine. Consequently, exchangers manufactured using this technology have a higher cost than exchangers with tubes and header boxes.

The subject of the present invention is a hydraulic circuit element for a heat exchanger that remedies these known drawbacks of the prior art.

For this purpose, each hydraulic circuit element of the exchanger comprises at least one tube, generally flat, having two ends and at least one tip fastened to one of said ends of the tube, said tip having at least one communicating passage that defines the path of the first fluid.

A circuit element of this type and the heat exchangers composed of such elements have many advantages.

The main advantage is flexibility. This is because the tips may have a very wide variety of configurations. An exchanger may consist of a stack of various circuit elements. Thus, according to the invention, it is possible to produce both a coil condenser and a parallel-tube condenser. It is also possible to produce a parallel-tube exchanger having passes without having to incorporate additional pieces, such as partitions. All that is required to do this is to use circuit elements whose tips possibly include appropriately assembled communicating passages.

Moreover, the invention allows the size of the exchanger to be reduced, while optimizing the effective area from the standpoint of heat exchange by replacing the header boxes with less bulky tips.

The invention also makes it possible to dispense with the punched header plates and the fitting of tubes into the small perforations of high tolerance in the header plates. The circuit elements may be delivered equipped with their tips, which makes it easier to assemble the exchanger. Thus, the mechanical function, consisting in inserting the tubes into pierced headers, is eliminated. All that is required is to assemble the tubes with tips, the dimensions of which are the same as those of the tubes. The circuit elements are then stacked. There is therefore great simplicity of assembly and of manufacture.

It is possible to produce an exchanger having tubes of different lengths. The shape of the exchanger can thus be matched to the available space in the vehicle.

Furthermore, fastening tabs may be fastened to the tips before or after the whole exchanger is brazed. The fastening tabs do not require particular matching of the bundle of the exchanger or of the tips.

According to the invention, it is possible to produce an exchanger of any type, namely a radiator, or a condenser, or an evaporator or an air cooler.

In a preferred embodiment, said tube or tubes are generally flat and/or said tip or tips are fastened to the ends of said tube or tubes.

In a simple embodiment, these circuit elements consist of a single tube having a terminal tip at each of its two ends.

In another, more complex, embodiment, the circuit elements consist of several tubes, an intermediate tip being present between two successive tubes.

The circuit elements may thus consist of two or three tubes, or even more.

The circuit elements consisting of several tubes may have a rectilinear shape or a broken-line shape.

In one embodiment, said tip or at least one of said tips of the exchanger consists of a strip of sheet metal folded to form two branches of equal length.

In another embodiment, the said tip or at least one of said tips consists of a strip of sheet metal folded to form two branches of unequal length.

Additional or alternative features of the circuit element of the invention are listed below:

- said tip or at least one of said tips has two bosses aligned along the longitudinal axis of said tube or tubes;
- said tip or at least one of said tips has two bosses aligned along a direction perpendicular to the longitudinal axis of said tube or tubes;
- said tip or at least one of said tips has two pairs of bosses, the two bosses of one and the same pair being aligned along a direction perpendicular to the longitudinal axis of said tube or tubes;
- said tube has a hole emerging laterally at one or both of its ends, allowing the fluid to pass between the inside of the tube and the fluid communication passages defined by said tips; and
- in such a case, said longitudinal orifices of the tube, provided emerging, may be closed off by a said tip, the fluid then flowing via said laterally emerging holes.

In another aspect, the invention relates to a heat exchanger, especially for a motor vehicle, comprising a stack of circuit elements as defined above that communicate via said tips in order to allow said first fluid to pass between said circuit elements.

Advantageously, some of the tips have bosses via which the circuit elements come into contact when they are stacked, in such a way that the bosses of one circuit element rest on the bosses of the adjacent circuit elements.

Advantageously, the exchanger includes an inlet nozzle and/or an outlet nozzle having a flattened end matching the available space between the ends of the two adjacent circuit elements.

According to yet another advantageous feature of the invention, the heat exchanger has two fastening tabs that are fastened to the tips of the circuit elements.

Other features and advantages of the present invention will become apparent on reading the following description of examples of embodiments given by way of illustration with reference to the appended figures. In these figures.

Figure 1:
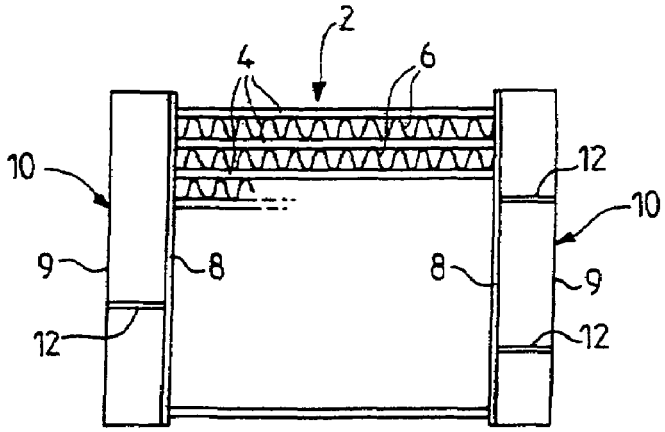
FIG. 1 is a view of a tube exchanger with header boxes according to the prior art.

FIG. 1 shows a heat exchanger of conventional type, comprising a bundle of flat tubes inserted between two header boxes. The bundle 2 is formed from a multiplicity of flat tubes 4 placed so as to be parallel to one another and alternating with corrugated spacers 6. These spacers are formed from a metal sheet that is deformed to form corrugations. A spacer 6 is placed between two adjacent tubes 4 and comes into respective contact with these two tubes 4 via end regions of the corrugations.

The tubes 4 of the bundle are inserted, at each of their ends, into perforations made in header plates 8, or so-called headers. The header plates 8 are closed by a cover 9 in order to constitute fluid boxes 10, for example water or air boxes.

To allow the tubes 4 to be mounted, it is necessary to punch the tube plates 8 and pierce them. The mounting of the tubes is not an easy operation.

The presence of the header boxes 10 increases the size of the exchanger without increasing its performance.

To create passes in the exchanger, it is necessary to incorporate partitions 12 that divide the header boxes 10 into separate chambers.

Figure 2:
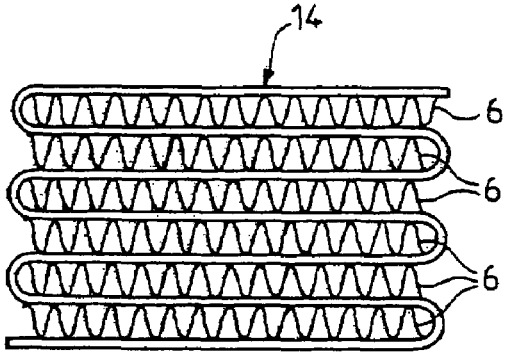
FIG. 2 is a view of a coil exchanger according to the prior art.

Shown in FIG. 2 is another known type of exchanger, namely a coil exchanger. The exchanger consists of a single tube 14 folded in the form of a coil. Corrugated spacers 6 may be placed between the outward and inward legs of the coil. An exchanger of this type is simpler than the tube-bundle exchanger with header boxes shown in FIG. 1. It has fewer parts. However, to industrialize its manufacture is difficult, and overall, a coil exchanger is more expensive to manufacture than a tube-bundle exchanger with header boxes. Furthermore, an exchanger of this type cannot be made with passes.

Figure 3:
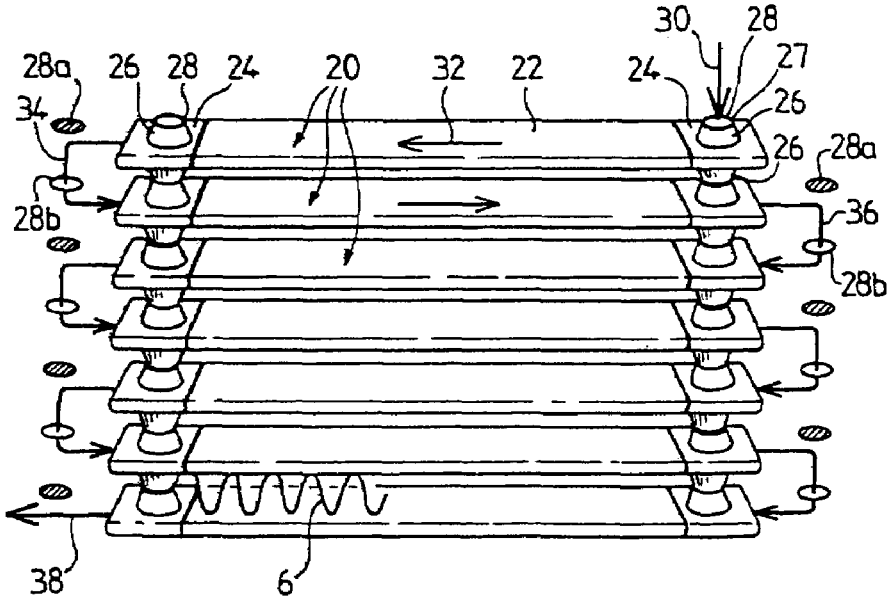
FIG. 3 is a perspective view of an exchanger according to the present invention.
Figure 4:
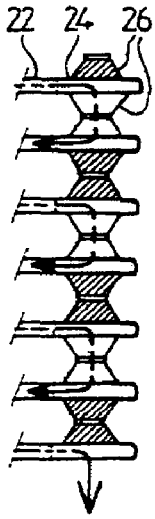
FIG. 4 is a partial sectional view of the part on the right, in the figure, of the exchanger shown in FIG. 3.

FIG. 3 shows an external perspective view of a heat exchanger according to the present invention and FIG. 4 shows a sectional view of the right-hand part. It is formed by a stack of circuit elements 20. Each circuit element 20 consists of at least one tube 22 having two ends. In the example shown, the circuit elements have only a single tube, but as will be seen later a circuit element may have several tubes. A tip 24 is fastened to each of the ends of the tube 22. In the example shown, the tips each comprise two bosses 26 (also called cups) of frustoconical shape. Each boss or cup 26 has a flat top 28. The flat tops 28 of the bosses of a tip of a circuit element 20 bear on the flat tops of the bosses of the adjacent circuit elements. Consequently, the various circuit elements 20 that make up the exchanger shown in FIG. 3 bear on one another via the flat tops of the bosses 26 of the tips of each of the circuit elements.

The flat tops 28 of the bosses 26 may be closed, that is to say having no perforation. In this case, they allow no circulation of the first fluid that flows in the tubes 22 of the exchanger between two adjacent circuit elements 20. However, the flat tops 28 may have perforations 27 facing each other in such a way that the first fluid can pass from one modular element to another.

In FIG. 3, the closed flat tops 28 have been shown schematically in perspective by a hatched small circle 28*a* and the perforated flat tops, allowing passage of the fluid, have been shown schematically by an unhatched small circle 28*b*. Thus, in the example shown in perspective in FIG. 3 and in sectional partial view in FIG. 4, the first fluid enters the exchanger in the upper right part of the exchanger, as indicated by the arrow 30. Since the flat top of the boss 26 facing the inlet of the fluid into the exchanger is blocked off (a closed top 28*a*), the first fluid moves from right to left (along the arrow 32) and travels along the upper tube 22 of the exchanger. The fluid reaches the tip 24 located in the part on the left (in FIG. 3) of the upper tube 22 of the exchanger. The upper boss 26 has a closed flat top 28, while the lower boss of the tip 24 has an open flat top 28*b*. The fluid can therefore pass from the upper circuit element 20 to the immediately lower circuit element, as shown schematically by the arrow 34. The first fluid then travels along the second circuit element 20 from the left to the right in FIGS. 3 and 4. At the right-hand end of the second circuit element 20 it passes into the lower circuit element (arrow 36) through the perforations 28*b* provided in the flat tops of the bosses, as described above. The fluid thus performs a series of outward and inward journeys in the tubes of the circuit elements from right to left and left to right, exactly as in a coil exchanger of the type shown in FIG. 2. The first fluid leaves the exchanger at the left-hand part of the latter, as shown schematically by the arrow 38.

During its alternating travel in the tubes 22 of the exchanger, the first fluid is in heat exchange relationship with a second fluid that flows in a conventional manner perpendicular to the bundle of tubes 22. Furthermore, corrugated spacers 6 may conventionally be placed between the tubes 22 of the exchanger as shown schematically in FIG. 3.

Thus, a heat exchanger is produced in a simple manner that allows heat exchange between a first fluid, generally a liquid, and a second fluid, generally a gas, especially atmospheric air, formed by a superposition of circuit elements 20 consisting of tubes fastened to the ends of which are tips, some of which have communicating passages 28*b* and others have no communicating passage. The superposition of the circuit elements defines the path of the first fluid.

FIGS. 3 and 4 show an example of an exchanger that defines a path for the first fluid that is identical to that of a coil exchanger. However, the construction of the exchanger allows great flexibility and a very large variety of exchangers may be obtained by simple superposition of circuit elements according to the invention.

It is important to note that the presence or absence of perforations 27 in the top 28 of the bosses 26 allows passes in the exchanger to be produced very simply. It is unnecessary to provide further attached pieces such as separating partitions 12 (see FIG. 1) that are usually present in order to form divisions between the header boxes 10 of the conventional-type exchangers.

When it is desired to provide a separation between two chambers, so as to produce passes in an exchanger, all that is required is to provide a circuit element whose tips do not have the perforation at the appropriate point. Thus, separated chambers are produced without the presence of a header box. This results in a smaller number of parts and a simplification of the exchanger.

Figure 5:
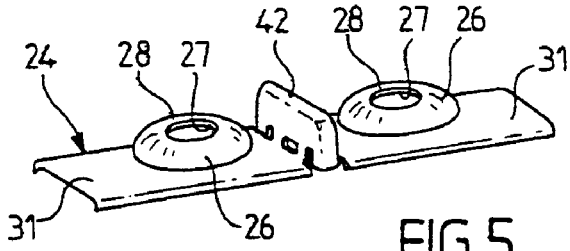
FIGS. 5 to 7 are various views that show a tip having branches of equal length that is intended to constitute a circuit element forming part of an exchanger according to the present invention.
Figure 7:
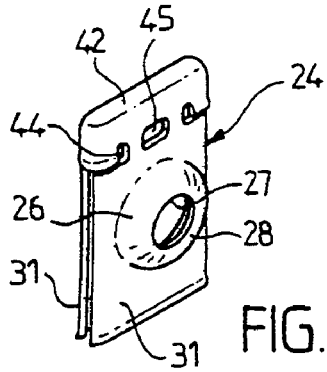
Figure 6:
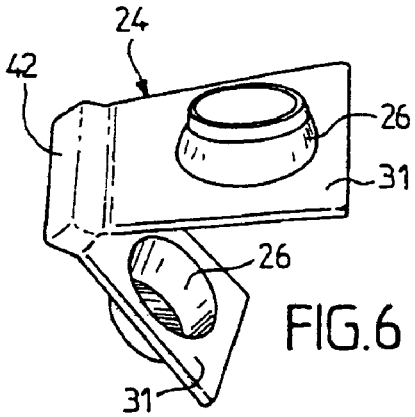
Figure 26:
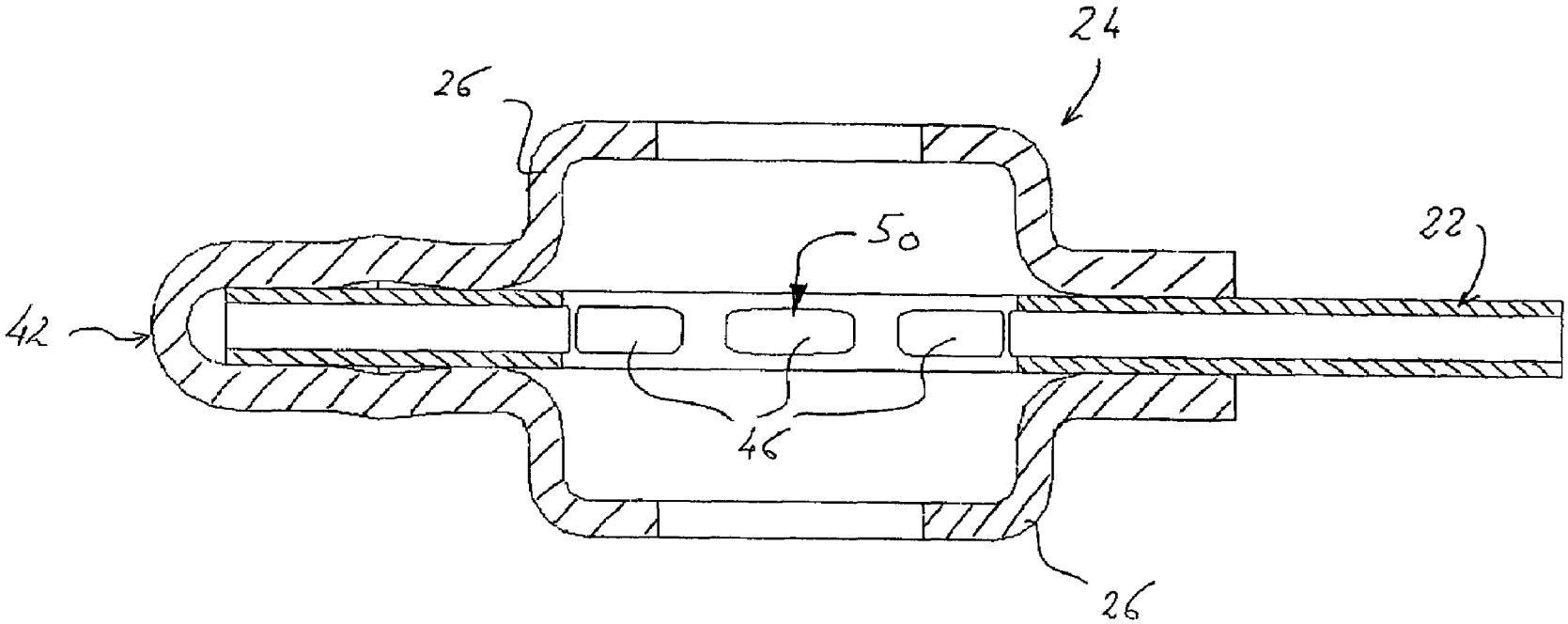
FIG. 26 illustrates, in a longitudinal sectional plane, the tube of FIG. 8, equipped with a tip such as that shown in FIG. 6.

FIGS. 5 to 7 show various views of a tip 24 intended for a circuit element 20 of a heat exchanger according to the invention, in particular for a heat exchanger shown in FIGS. 3 and 4. As may be seen in FIG. 5, the tips are produced by the stamping and folding of a metal strip, preferably aluminum, having two branches 31. The stamping operation is used to produce the two bosses 26 and, optionally, the perforations 27 in the flat top 28 of the bosses 26, if these perforations are to exist. Furthermore, an upstand 42 is formed in the aluminum strip between the branches 31 in which the two bosses 26 are formed, thereby connecting the two branches along the respective edges. As best shown in FIG. 26, the upstand 42 constitutes the end wall of the tip and forms an enclosed receiving cap that receives an end of the tube 22, as the end of the tube 22 extends past the communicating passage 28*b*. The enclosed receiving cap seals the end of the tube 22 to prevend fluid flow from the end of the tube, i.e. to prevent liquid from escaping in the axial direction of the tube after a circuit element has been assembled. The strip of sheet metal is then folded so as to bring the two parts having the upstands closer together, as may be seen in FIG. 6.

In FIG. 7, the two branches 31 have been folded over entirely and the tip is shown completed. It is then assembled, for example by clipping, fitting or crimping onto a tube 22 before brazing. Perforations 44 and 45 make it easier for the tip to be brazed onto the end of the tube 20.

Such a manufacture solves a problem encountered in conventional tube-bundle exchangers with collector boxes, namely that of fitting a small tube into a large header having small holes with tight tolerances. According to the invention, this problem is obviated. All that is required is to assemble the tips 24 on tubes 22 having the same dimensions. This dispenses with the mechanical function of introducing tubes into pierced headers. As a result, it is extremely simple to assemble and manufacture the exchanger.

Manufacture of the exchanger will therefore have a production station for producing the tubes, a press for producing the tips and an automatic machine for inserting the tips onto the tubes. The manufacture then passes directly to assembling the exchanger by superposing the circuit elements thus manufactured, optionally with the interposition of corrugated spacers 6. The whole unit is then assembled by brazing.

Figure 8:
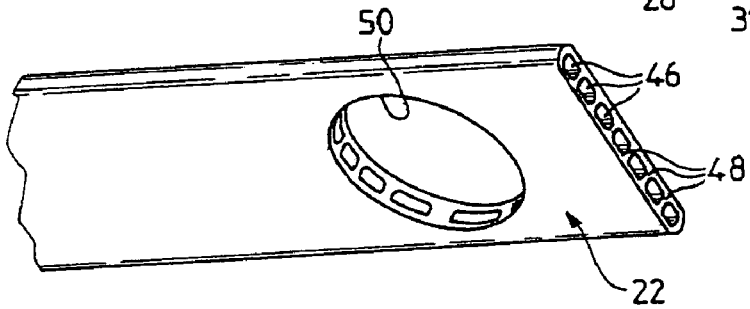
FIG. 8 is a perspective view of the end of a tube having a communicating hole.

FIG. 8 shows a perspective view of the end of one particular embodiment of a tube 22 intended for the construction of a circuit element according to the invention. As may be seen, this tube is a multichannel tube. It has seven channels 46 separated by six separating partitions 48. Such a tube is intended, for example, to contain a pressurized fluid. The separating partitions 48 strengthen the tube and prevent it from bowing under the pressure of the fluid. Furthermore, the particular feature of this tube lies in the fact that it has a circular through-hole 50 at one of its ends or at both its ends (only one end is shown). Thus, communication between the tube and the tip may be provided in two different ways. In a first embodiment, the tip 24 is simply clipped onto the free end of the tube and the fluid leaves the tube or enters therein via the end of the latter. In this case, the tube has no perforations 50. In another embodiment, the tips 24 are fitted onto the end of the tube in such a way that the hole 50 lies approximately facing the perforations 27 of the bosses 26. In this case, communication between the tube and the tip is provided by the perforations 50. The bosses 26 lie, for example, along the axis of the perforations 50.

In this case, the longitudinal orifice or orifices of the tube 22 may be closed by the tip 24, more precisely by the upstand 42 constituting the end wall of the said tip.

FIGS. 9, 10, 11 and 12 show various alternative embodiments of the tip shown in FIGS. 5 to 7. The tip of FIG. 9, instead of having only one boss 26 on each of its branches 31, like the tip in FIGS. 5 to 7, has two bosses, i.e. four bosses in total. These tips are made in the same way as the tip in FIG. 5, namely by stamping and folding a strip of aluminum. The flat tops 28 of the tips 26 may or may not be perforated depending on the characteristics of the exchanger to be produced.

Figure 9:
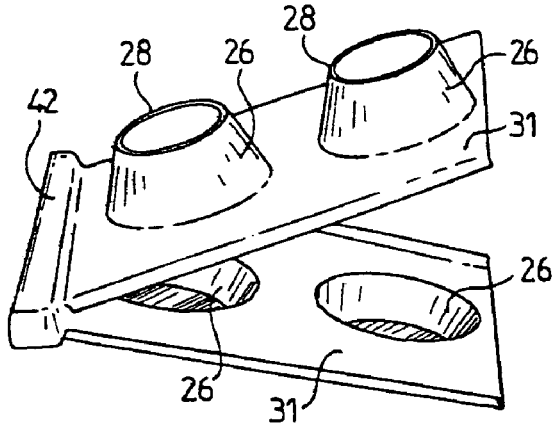
FIG. 9 is a perspective view of a tip having two bosses that are aligned longitudinally with respect to the axis of the circuit element.
Figure 10:
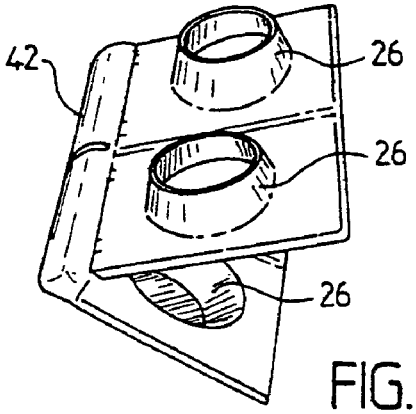
FIG. 10 is a perspective view of a tip having two bosses that are aligned in a direction perpendicular to the longitudinal axis of the circuit element.

FIG. 10 shows a perspective view of a tip in the course of being produced. This tip has two pairs of bosses 26 on each of its branches, like that in FIG. 9. However, the bosses 26, instead of being placed along the axis of the circuit element, that is to say along the axis of the tube 22, like the bosses of the tip shown in FIG. 9, are placed beside each other. In other words, they are placed in such a way that their axis lies on a line perpendicular to the longitudinal axis of the circuit element. A tip of this type can be applied to a tube having several channels, for example two channels or more than two channels. Some of the channels of the tube communicate with the left-hand part of the tip, whereas the other channels of the tube communicate with the right-hand part of the tip (as in FIG. 10). Alternatively, in another embodiment, two different tubes 22 may be fitted onto a single tip, like the one shown in FIG. 10.

Figure 11:
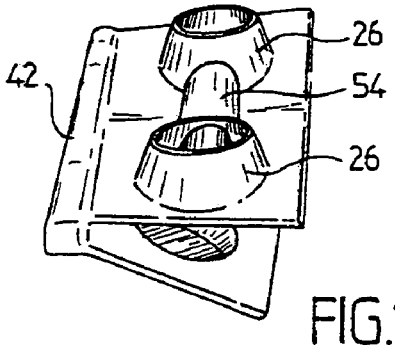
FIG. 11 is a perspective view of a tip similar to that shown in FIG. 10, but having a communicating channel between the two bosses.

FIG. 11 shows a perspective view of a tip 24 similar to that of FIG. 10. However, it is distinguished therefrom by the fact that the two bosses 26 visible in the upper part of FIG. 11 are connected via a communicating channel 54. The presence of the channel 54 makes it possible to establish, according to the requirements, communication between the internal volumes of the two embossments 26. A communicating channel 54 may be provided on one of the faces of the tip or on both faces. The channel 54 is preferably made by stamping at the same time as the embossments 26.

Figure 12:
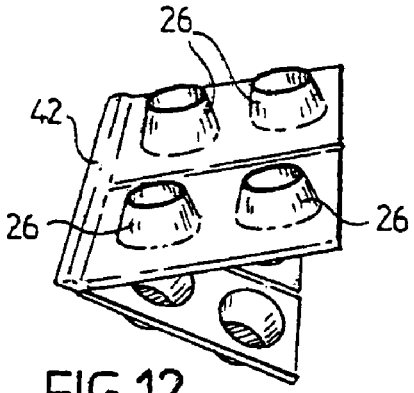
FIG. 12 is a perspective view of a tip having two pairs of bosses.

FIG. 12 shows a perspective view of a larger tip, having four bosses 26 on each of its branches, i.e. eight bosses in total. The bosses 26 are distributed in two pairs, each pair being aligned along the longitudinal axis of the tube.

Figure 13:
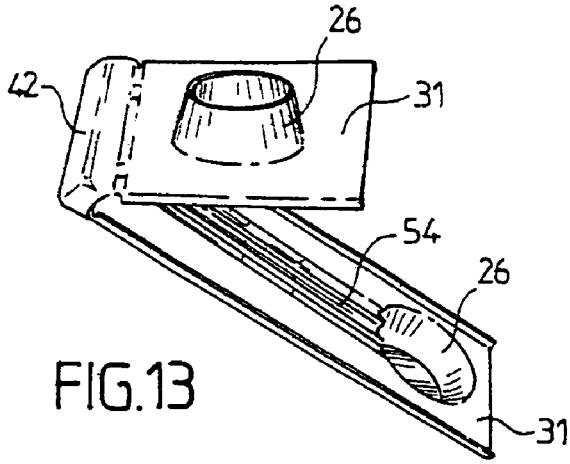
FIG. 13 is a perspective view of a tip having branches of unequal length.

FIG. 13 shows a perspective view of another embodiment of a tip according to the present invention.

It is distinguished from the previous tips in that it has two branches 31 or legs of different lengths. This is because the tips shown in FIGS. 5 to 12 all have branches of the same length, which superpose one on top of the other when they are completely folded over, as may be seen for example in FIG. 7. The tip shown in FIG. 13 has two legs or branches 31 of different length. Each branch has a perforated embossment 26, in such a way that they are not entirely superposed one on top of the other. Furthermore, it may be seen that the longer branch has a communicating channel 54, preferably formed by stamping the strip of sheet metal at the same time as the end upstand 42 and the two bosses 26.

Figure 14:
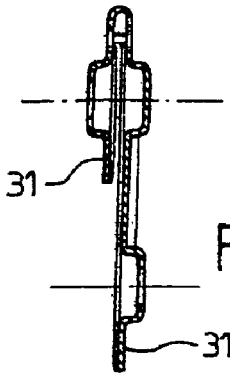
FIG. 14 and FIG. 15 are views of a tip having branches of unequal length with bosses connected via a communicating channel.
Figure 15:
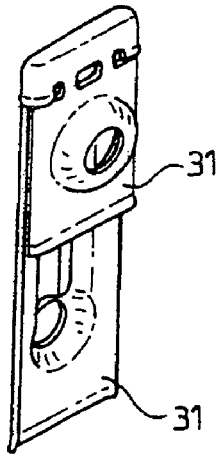

FIGS. 14 and 15 show an alternative embodiment of the tip of FIG. 13. It is distinguished in that the longer branch 31 has two embossments 26 instead of just one. One of the embossments 26 of the longer branch lies facing the embossment of the shorter branch, whereas the embossment 26 located at the end of the longer branch faces nothing. Furthermore, a communicating channel 54 connects the embossments 26 of the longer branch.

Figure 16:
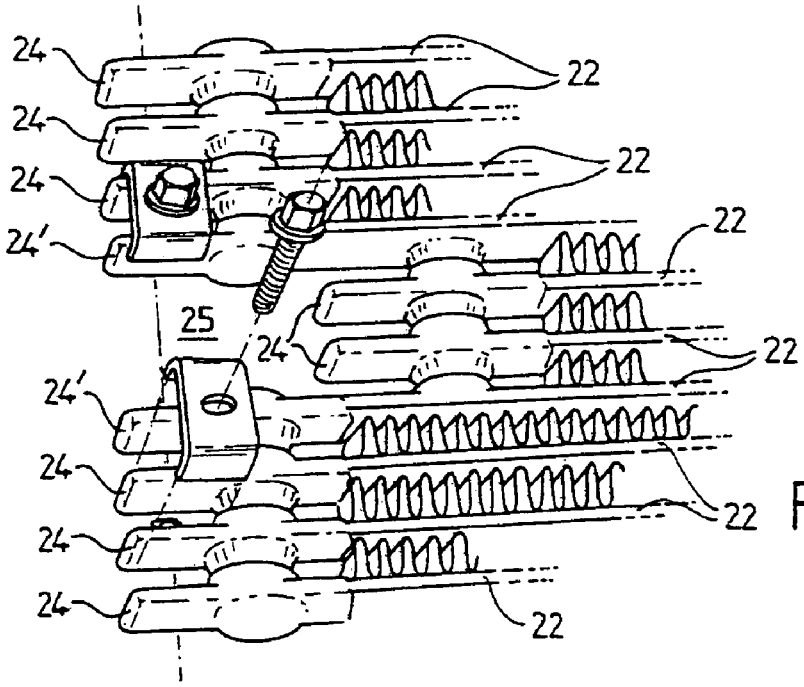
FIG. 16 is a partial view in perspective of an exchanger according to the present invention.

FIG. 16 shows one possible application of tips having branches 31 of unequal length, such as those shown in FIGS. 13 to 15. The tips 24 of the circuit elements 20 located in the upper part and the lower part of the exchanger have branches 31 of equal length. Similarly, the tips 24 of the two circuit elements 20 that are located at the center of the exchanger also have legs of equal length. On the other hand, two particular tips, referenced 24', have branches of unequal length. The tip 24' located in the upper part of the exchanger makes it possible to provide the transition between the four longer tubes 22 located in the upper part of the exchanger and a shorter tube. Similarly, the tip 24' located in the lower part of the exchanger makes it possible to provide a transition between the four longer tubes 22 located in the lower part of the exchanger and a shorter tube. Thus, an open space 25 is provided in the body of the exchanger. This feature makes it possible, for example, to match the geometric shape of the exchanger to the space available in the vehicle. This makes it easier for it to be fitted and constitutes an advantage over the conventional exchangers that necessarily have to be of rectangular shape owing to the presence of the header boxes 10 (FIG. 1).

Figure 17:
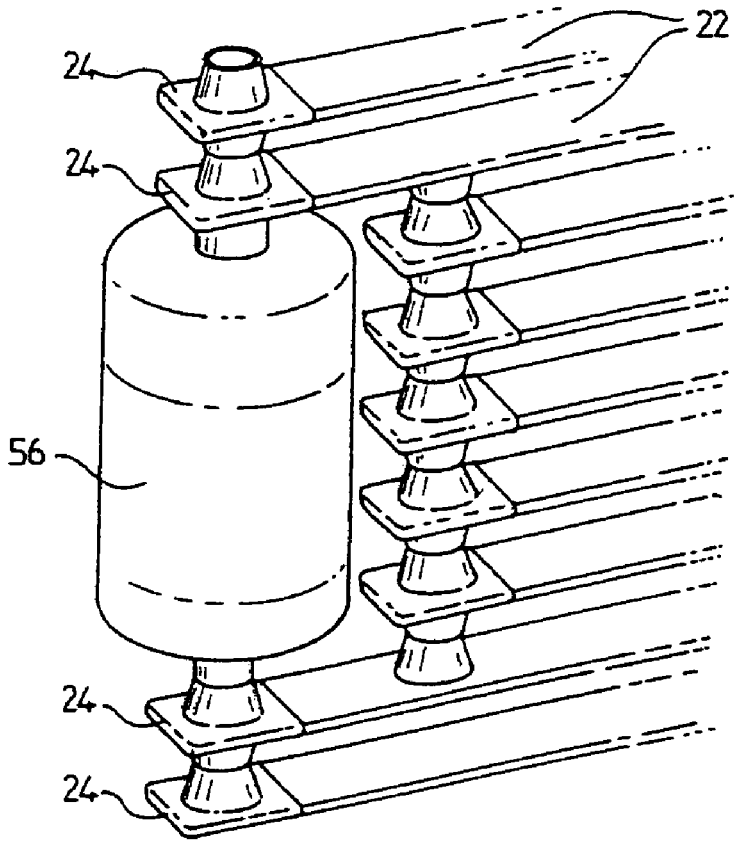
FIG. 17 shows an example of an application of circuit elements having tips with branches of unequal length.

FIG. 17 shows a partial schematic view in perspective of another application of a tip having branches of unequal length. The space left free by the shorter tubes 22 allows a bottle 56, for example a condenser bottle, to be fitted.

Figure 18:
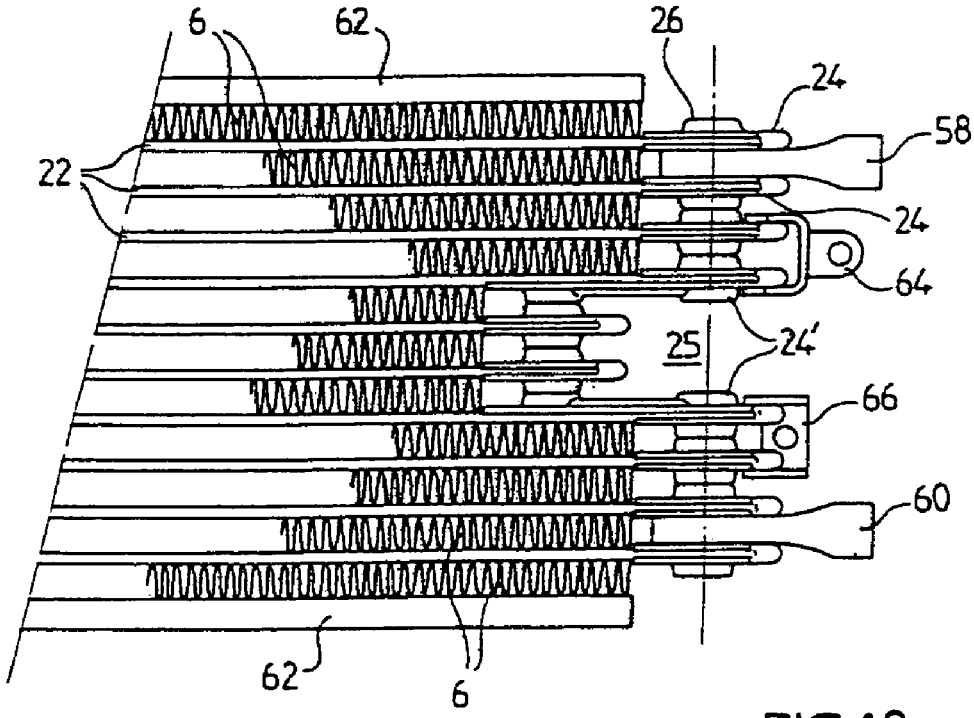
FIG. 18 shows a fitting of the inlet and outlet nozzles in an exchanger according to the present invention.

FIG. 18 shows a partial elevation of a heat exchanger according to the present invention. This view shows in particular the construction of the inlet 58 and outlet 60 nozzles for the first fluid. These nozzles are interposed between the ends of two circuit elements. On the same side as the inlet 58 and outlet 60 nozzles, the tips 24 have no bosses 26. Thus, it is possible to insert the end of the nozzles, which are flattened so as to be shaped exactly to the space available between two adjacent tubes.

FIG. 18 also shows the end cheek plates 62, formed for example by a metal sheet folded into a U, and the presence of fastening tabs 64 and 66 that are fastened to the tips 24 of certain circuit elements of the exchanger, for example by brazing. Finally, it will be noted that there are two special tips, referenced 24', which have branches of unequal length so as to provide a transition between longer tubes and shorter tubes, thereby leaving a space 25 between the tubes of the exchanger, as was described above with reference to FIGS. 16 and 17.

Figure 19:
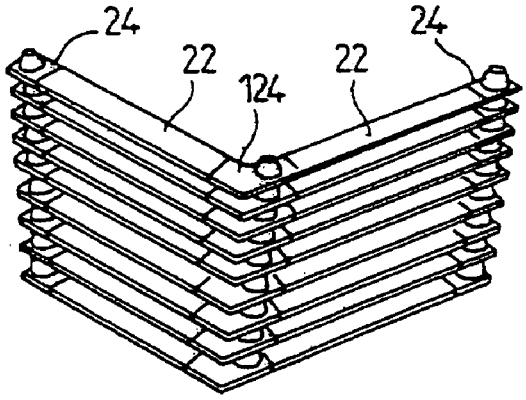
FIG. 19 is a perspective view of an exchanger formed by a stack of circuit elements consisting of two tubes connected by an intermediate tip.
Figure 20:
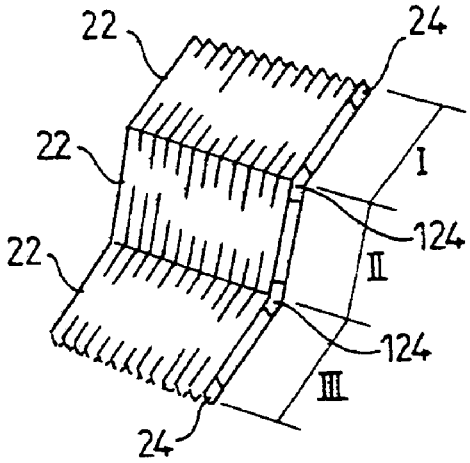
FIG. 20 is a perspective view of an exchanger, the circuit elements of which consist of three tubes joined together by intermediate tips.

In the embodiments described above, the exchanger consists of circuit elements having a single tube 22. The circuit elements which make up the exchanger of the invention may also have two tubes (FIG. 19) or more than two tubes (FIG. 20), for example three tubes, or even more. In this case, each circuit element 20 has two different types of tips, namely terminal tips or end tips 24, described above, on the one hand, and intermediate tips, denoted by the reference 124, on the other. The intermediate tips are distinguished from the terminal tips by the fact that they are connected to two different tubes instead of being fastened to the end of a single tube. The circuit elements of the exchanger that are shown in FIG. 19 have a single intermediate tip 124. The circuit elements of the exchanger that are shown in FIG. 20 have two intermediate tips 124.

Figure 21:
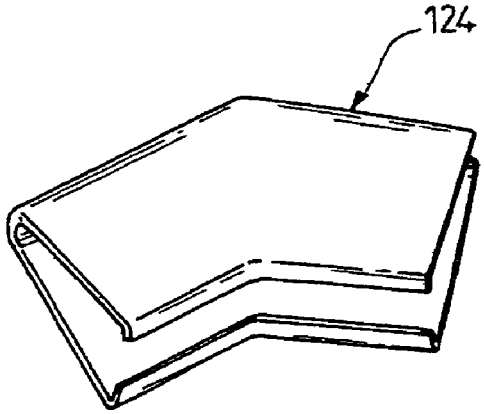
FIGS. 21 to 23 are perspective views that show the construction of various alternative embodiments of intermediate tips for exchangers, such as those shown in FIGS. 19 and 20.

FIG. 21 shows a perspective view that illustrates the construction of an intermediate tip 124. The intermediate tips, like the end tips, are obtained from a metal sheet, preferably an aluminum sheet. Firstly, this sheet is cut in order to obtain a Y-shape (not shown). The Y-shape is folded into two and the ends are bent over so as to obtain a closed shape, like that shown in FIG. 21. A tube 22 is then fitted onto each of the ends of this closed shape. The intermediate tips may make an angle as shown in FIGS. 19, 20 and 21. However, the intermediate tips could also be rectilinear.

Figure 22:
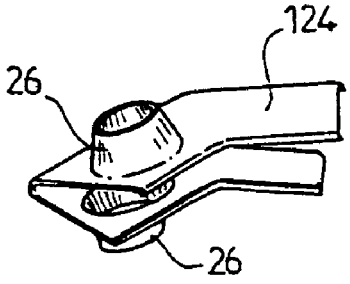
Figure 23:
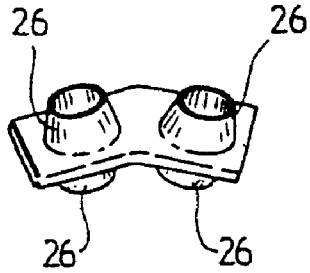

The intermediate tip shown in FIG. 21 is simple insofar as it does not have any connection for the entry or exit of the first fluid. However, an intermediate tip may also have bosses 26 that allow entry or exit of the first fluid at the point of connection between two tubes of a particular circuit element 20, as shown in FIG. 22. The intermediate element 124 may also have several bosses 26, for example two pairs of bosses as shown in perspective in FIG. 23.

Figure 24:
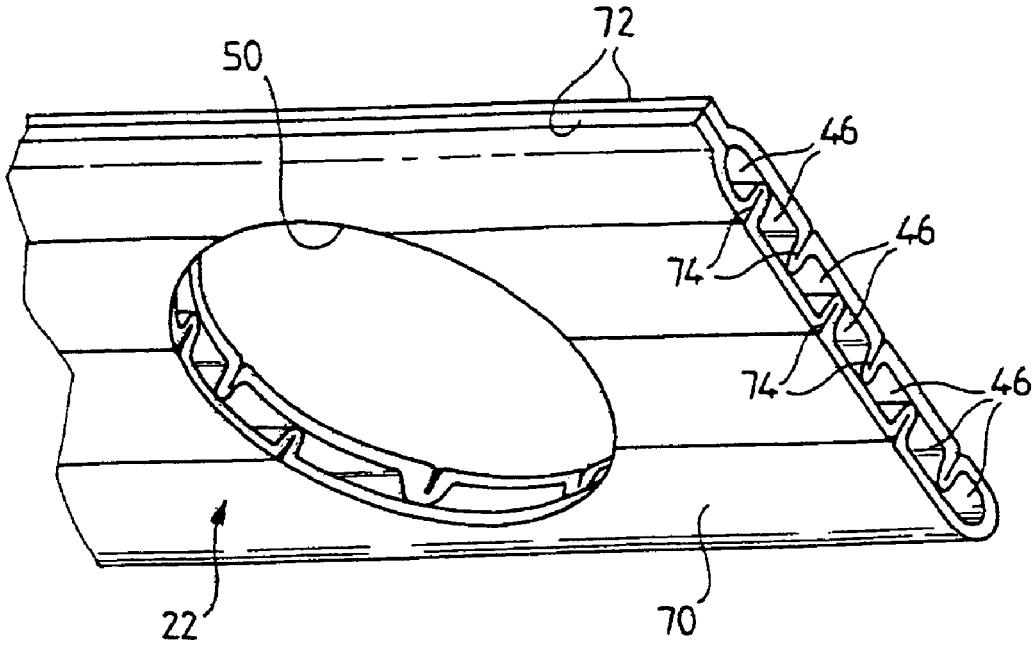
FIGS. 24 and 25 illustrate two alternative embodiments of the tube shown in FIG. 8.

The tube 22 shown in FIG. 24 is similar to the tube 22 of FIG. 8, except that it is made by shaping a folded sheet 70 and not by extrusion. This sheet 70 has two longitudinal edges 72 that are joined together. This sheet also has internal folds 74 suitable for defining partitions that delimit seven internal channels 46. The tube also has a circular through-hole 50 similar to that of the tubes of FIG. 8.

Figure 25:
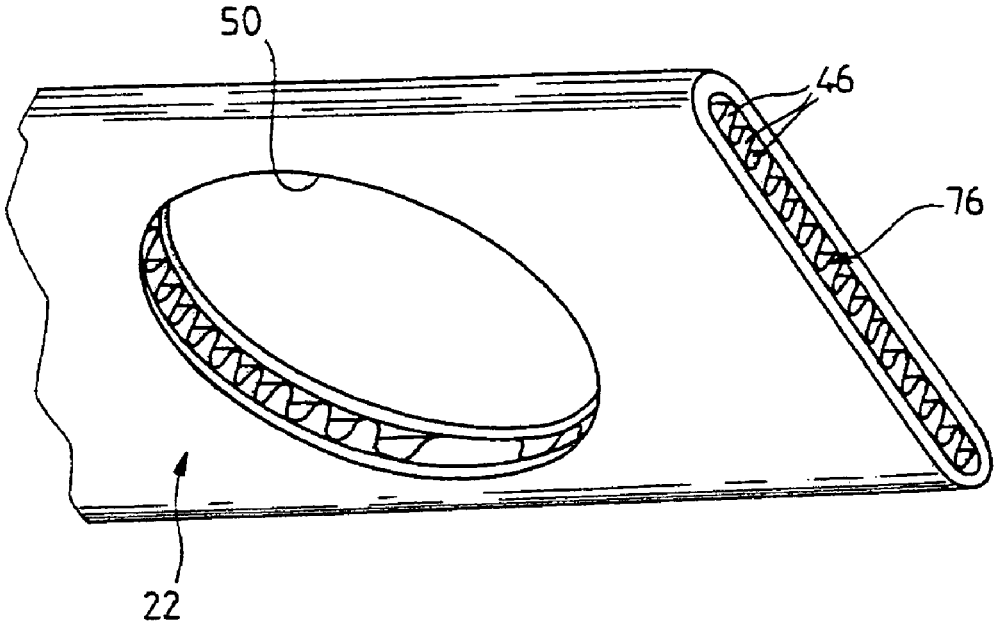

The tube 22 shown in FIG. 25 is also similar to that of FIG. 8. Again this is a flat tube produced, in the example, by extrusion. This tube, on the inside, hugs a corrugated insert 76, thereby making it possible to define a multiplicity of circulating channels 46 inside the tube.

The circuit element of the invention can be used to produce various types of heat exchanger, particularly condensers for air-conditioning units on motor vehicles.

The invention claimed is:

1. Hydraulic circuit element (20), for heat exchange between a first and a second fluid, which defines a path for the first fluid, comprising at least one tube (22) having two ends and at least one tip (24) at one of said ends of the tube (22), said tip having at least one communicating passage (28*b*) that defines the path of the first fluid, said tip (24) comprising a strip of sheet metal defining two branches (31) and an upstand (42) connecting the two branches (31) along respective edges, the upstand (42) forming an enclosed receiving cap that receives one of said ends of the tube as the end extends past said at least one communicating passage (28*b*) and seals it to prevent fluid flow from said end.

2. Circuit element according to claim 1, wherein said tube or tubes (22) are generally flat and/or said tip or tips (24) are fastened to the ends of said tube or tubes (22).

3. Circuit element according to claim 1 wherein it comprises a single tube (22) having a terminal tip (24) at each of its ends.

4. Circuit element according to either of claims 1 and 2, characterized in that it consists of several tubes (22), an intermediate tip (124) being present between two successive tubes (22).

5. Circuit element according to claim 4, characterized in that it has a rectilinear shape.

6. Circuit element according to claim 4, characterized in that it has a broken shape.

7. Circuit element according to claim 1, characterized in that said tip (24) or at least one of said tips consists of a strip of sheet metal folded to form two branches (31) of equal length.

8. A Hydraulic circuit element (20), for heat exchange between a first and a second fluid, which defines a path for the first fluid, comprising at least one tube (22) having two ends and at least one tip (24) at one of said ends of the tube (22), said tip having at least one communicating passage (28*b*) that defines the path of the first fluid wherein said tip (24) or at least one of said tips consists of a strip of sheet metal folded to form two branches (31) of unequal length.

9. A Hydraulic circuit element (20), for heat exchange between a first and a second fluid, which defines a path for the first fluid, comprising at least one tube (22) having two ends and at least one tip (24) at one of said ends of the tube (22), said tip having at least one communicating passage (28*b*) that defines the path of the first fluid wherein said tip (24) or at least one of said tips has two bosses (26) aligned along the longitudinal axis of said tube or tubes (22).

10. Circuit element according to claim 1 wherein said tip (24) or at least one of said tips has two bosses (26) aligned along a direction perpendicular to the longitudinal axis of said tube or tubes (22).

11. Circuit element according to claim 1, characterized in that said tip (24) or at least one of said tips has two pairs of bosses (26), the two bosses of one and the same pair being aligned along a direction perpendicular to the longitudinal axis of said tube or tubes (22).

12. Circuit element according to claim 9 wherein said tip (24) includes a strip of metal defining two branches (31), characterized in that a communicating channel (54) is formed in at least one of said two branches (31) of the tip (24) in order to establish a flow of the first fluid between the bosses (26).

13. Heat exchanger for a motor vehicle comprising a stack of circuit elements (20) according to claim 1 that communicate via said tips (24) in order to allow said first fluid to pass between said circuit elements.

14. Heat exchanger according to claim 13, wherein some of the tips (24) have bosses (26) via which the circuit elements (20) come into contact when they are stacked, in such a way that the bosses (26) of one circuit element (20) rests on the bosses (26) of the adjacent circuit elements (20).

15. Heat exchanger according to claim 13, characterized in that it includes an inlet nozzle (58) and/or an outlet nozzle (60) having a flattened end matching the available space between the ends of the two adjacent circuit elements (20).

16. Heat exchanger according to one of claims 13 to 15, characterized in that it has two fastening tabs (64, 66) that are fastened to the tips (24) of the circuit elements (20).

17. Circuit element according to claim 2, wherein it comprises a single tube (22) having a terminal tip (24) at each of its ends.

18. Circuit element according to claim 2, wherein said two branches (31) comprise an unequal length relative to each other.

19. Circuit element according to claim 2, wherein said tip (24) or at least one of said tips has two bosses (26) aligned along the longitudinal axis of said tube or tubes (22).

20. Circuit element according to claim 2, wherein said tip (24) or at least one of said tips has two bosses (26) aligned along a direction perpendicular to the longitudinal axis of said tube or tuber (22).

21. Heat exchanger for a motor vehicle comprising a stack of circuit elements (20) according to claim 2 that communicate via said tips (24) in order to allow said first fluid to pass between said circuit elements.

22. Heat exchanger according to claim 21, wherein some of the tips (24) have bosses (26) via which the circuit elements (20) come into contact when they are stacked, in such a way that the bosses (26) of one circuit element (20) rests on the bosses (26) of the adjacent circuit elements (20).

23. A hydraulic circuit element (20) as set forth in claim 1 wherein said at least one tip (24) includes a perforation (44, 45) disposed between each of said two branches (31) and said upstart (42).

* * * * *

UNITED STATES PATENT AND TRADEMARK OFFICE

CERTIFICATE OF CORRECTION

PATENT NO. : 7,337,833 B2
APPLICATION NO. : 10/499871
DATED : March 4, 2008
INVENTOR(S) : Jean-Louis Laveran et al.

It is certified that error appears in the above-identified patent and that said Letters Patent is hereby corrected as shown below:

Column 10, line 37, claim 20 after or delete [tuber], and insert therein --tubes--

Column 10, line 51, claim 23 after said delete [upstart], and insert therein --upstand--

Signed and Sealed this

Fifth Day of August, 2008

JON W. DUDAS
*Director of the United States Patent and Trademark Office*